US008490539B2

(12) United States Patent
Otto

(10) Patent No.: US 8,490,539 B2
(45) Date of Patent: Jul. 23, 2013

(54) METHOD AND DEVICE FOR STABILIZING WEAPONS

(75) Inventor: Stephan Otto, Hamburg (DE)

(73) Assignee: ESW GmbH, Wedel (DE)

( * ) Notice: Subject to any disclaimer, the term of this patent is extended or adjusted under 35 U.S.C. 154(b) by 167 days.

(21) Appl. No.: 12/883,604

(22) Filed: Sep. 16, 2010

(65) Prior Publication Data

US 2011/0168006 A1 Jul. 14, 2011

(30) Foreign Application Priority Data

Sep. 16, 2009 (DE) ..... 10 2009 042 517

(51) Int. Cl.
*F41A 27/02* (2006.01)

(52) U.S. Cl.
USPC ..... 89/41.02

(58) Field of Classification Search
USPC ..... 89/41.02–41.04, 41.06, 41.07, 41.09, 89/41.11, 41.12, 41.15, 41.16, 42.01, 43.01, 89/37.05, 37.01, 37.02, 37.09
See application file for complete search history.

(56) References Cited

U.S. PATENT DOCUMENTS 339,466 A * 4/1886 Powlett ..... 89/41.12
3,677,135 A 7/1972 Haug, Jr.
5,631,437 A * 5/1997 LaVigna et al. ..... 89/14.3
6,453,792 B1 9/2002 Hampton
6,497,171 B2 * 12/2002 Gerber et al. ..... 89/41.09
7,350,452 B2 4/2008 Plumier et al.

FOREIGN PATENT DOCUMENTS

DE 3733215 A1 4/1989
DE 19832495C1 Y 10/1999
DE 60209763T2 A 8/2006
DE 102005059225 Y 6/2007

* cited by examiner

*Primary Examiner* — Michael Carone
*Assistant Examiner* — Reginald Tillman, Jr.
(74) *Attorney, Agent, or Firm* — Lucas & Mercanti, LLP; Klaus P. Stoffel

(57) ABSTRACT

The method serves for adjusting a positioning of a longitudinal axis of a weapon barrel. An adjusting angle of the weapon barrel is changeable by at least one adjusting element. The weapon barrel is arranged so as to be movable relative to a weapon support in the direction of the longitudinal axis. A positioning of the weapon barrel relative to the weapon support is determined by measurement technology. The measurement values obtained as a result are supplied to a control device. The control device acts on the adjusting element in accordance with a predetermined functional relationship between the obtained measurement values and an input value for the adjusting element. The device for firing shell s is constructed for use of the respective method.

16 Claims, 2 Drawing Sheets

METHOD AND DEVICE FOR STABILIZING WEAPONS

BACKGROUND OF THE INVENTION

The invention relates to a method for adjusting a positioning of a longitudinal axis of a barrel of a weapon, wherein an angle of incidence of the barrel can be adjusted by at least one adjusting element, and wherein the barrel is arranged so as to be movable relative to a weapon support in the direction of the longitudinal axis.

The invention additionally relates to a device for firing shells which includes a weapon barrel guided by a weapon support which is positionable with a longitudinal axis relative to the horizontal direction by an adjusting element with an angle of incidence, and wherein the weapon barrel is mounted so as to be movable in the direction of the longitudinal axis by the weapon support.

Such methods and devices relate especially to large-caliber weapons in which a return travel of the weapon barrel relative to the weapon support is possible. The appropriate return travel can take place prior to, during and after a firing of shot and leads to changes of the mechanical system inertia as well as to an imbalance change of the respective weapon relative to the trunnion. Especially the rearward displacement of the center of gravity because of the return travel of the barrel leads to a vertical pivoting movement of the barrel which is counteracted by alignment regulators and stabilization regulators.

The change of the imbalance additionally leads to changes of the momentum or force in the drive train for the weapon positioning. Since the respective drive train only has a limited stiffness, the change of the imbalance leads to a movement of the weapon which negatively affects the stabilization quality as well as the alignment accuracy.

The change of the mechanical inertia additionally results in a change of the dynamic properties of the regulation stretches. Finally, the movement of the barrel also causes a change of the resulting speed due to the law on the preservation of the angular momentum.

The directional regulators used in accordance with the prior art as well as the stabilization regulators react to position deviations and deviations of the rate of rotation of the barrel which are caused by imbalance changes and/or inertia changes.

Consequently, a regulation of the initially occurring regulation deviations takes place, which lead to a regulation error and, thus, to deviations.

SUMMARY OF THE INVENTION

Therefore, it is the object of the present invention to improve a method of the above-mentioned type in such a way that occurring regulation errors are minimized.

In accordance with the invention, this object is met by measurement-technically measuring a positioning of the weapon barrel relative to the weapon support and supplying the measurement values obtained as a result to a control device which acts on the adjusting element in dependence on a predetermined functional relationship between the determined measurement values and an input value for the adjusting element.

Another object of the present invention is to construct a device of the above-mentioned type in such a way that the occurring regulation deviations are minimized.

In accordance with the invention, this object is met by connecting at least one sensor to a control device for determining a positioning of the weapon barrel relative to the weapon support, and by having the control device act upon the adjusting element with an input value which can be determined by a functional relationship of the determined measurement values.

In accordance with the invention, it has been recognized that the imbalance changes as well as the inertia changes, in view of the dynamic period to be considered, are only dependent on the return travel distance of the weapon barrel. The imbalance as well as the inertia constitute geometric properties which are dependent directly on the return travel distance of the weapon travel and which can be determined through a distance pickup. Consequently, the imbalance and the inertia are known at any time of the operation. The distance measurement takes place with the use of the distance pickup in accordance with different physical principles, for example, mechanically, inductively, capacitively, optically or magnetically.

The concrete dynamics of the return travel of the weapon barrel depends on a number of parameters. For example, these parameters are the occurring wear, the operating temperature, the ammunition temperature, the barrel temperature and the time of firing. However, the respective parameters only influence the dynamic processes up to the achieving of certain positions of the barrel return travel, but not the changes of the imbalance and the inertia resulting from a concretely present return travel positioning.

When carrying out a position regulation, it is particularly intended to adjust a predeterminable positioning of the longitudinal axis of the weapon barrel. Alternatively to the adjustment of the positioning of the longitudinal axis relative to the horizontal direction, it is also possible to carry out an alignment only with the use of a sight instrument. If appropriate, no indication is given of a positioning to be maintained, but rather a speed is preset for the adjustment.

A preferred use of the principle according to the invention takes place in heavy weapons with forward travel firing. Generally, a use can take place, for example, in fighter tanks or in howitzers.

In accordance with a simplified embodiment, it is provided that the measurement values are used exclusively for controlling the adjusting elements.

Optimized system properties can be achieved by using the measurement values for an advance control as well as for a regulation. In particular, a use can take place for an advance control as a part of a regulation.

For achieving advantageous dynamic properties, a contribution is made if the adjusting element is an electric motor.

A further improved system property can be achieved by using the adjusting element as part of a cascade-type regulation.

When electrical adjusting elements are used, it has been found advantageous if an intended value is supplied to the adjusting element as the value for the torque. In practice, it is preferred to use the intended value for a motor current.

A minimum deviation from the regulation is supported by carrying out an advance control with respect to at least two parameters.

In particular, it is intended that a pre-control takes place with respect to the torque as well as the motor current and also with respect to the rate of rotation and the position.

BRIEF DESCRIPTION OF THE DRAWINGS

In the drawings, embodiments of the invention are schematically illustrated. In the drawing.

DETAILED DESCRIPTION OF THE INVENTION

Figure 1:
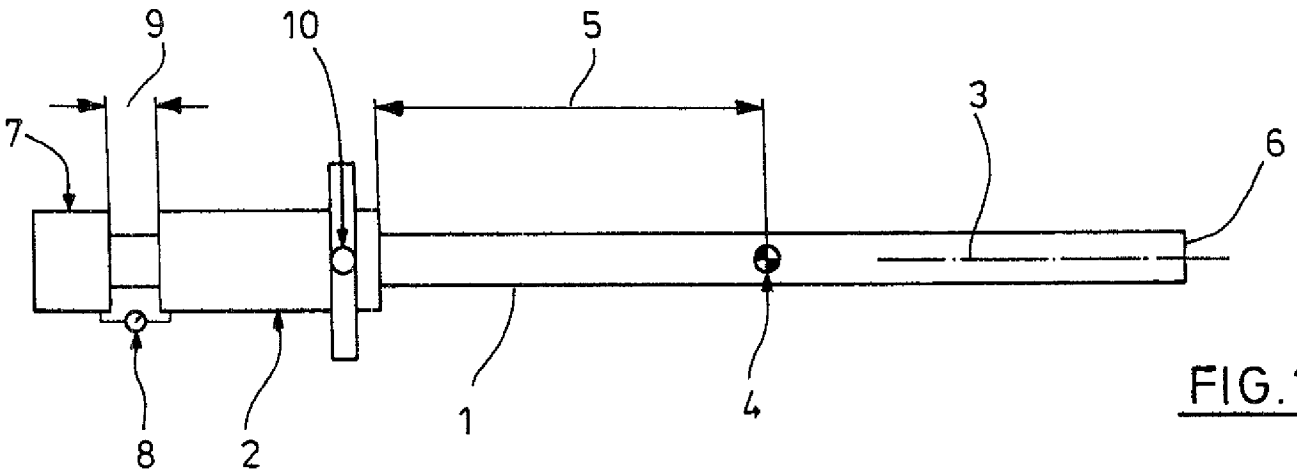
FIG. 1 is a side view of a weapon barrel guided by a weapon support, shown in a basic position.

In accordance with the embodiment of FIG. 1, a weapon barrel 1 is positionably supported and guided by a weapon support 2 in the direction of a longitudinal axis 3. A center of gravity 4 of the barrel 1 is positioned at a distance 5 from the weapon support 2. A lock 7 is arranged in an end of the weapon barrel 1 facing away from the mouth 6 of the weapon barrel 1.

A sensor 8 is used for determining a return travel of the weapon barrel 1 relative to the weapon support 2. The sensor 8 can determine, for example, a distance 9 between the lock 7 and the weapon support 2. In order to be complete, FIG. 1 shows also a trunnion 10, which is arranged in the area of the weapon support 2.

Figure 2:
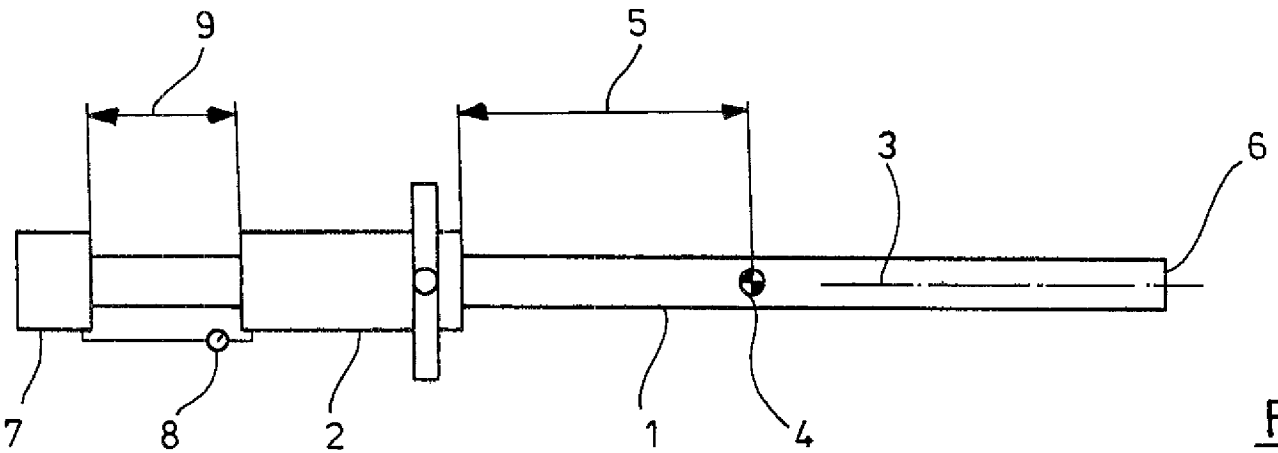
FIG. 2 is an illustration of the arrangement according to FIG. 1, shown after at least a partial return travel of the weapon barrel.

FIG. 2 shows the arrangement according to FIG. 1 after an at least partial return travel of the barrel 1. It can be seen that the distance 5 between the center of gravity 4 and the weapon support 2 is reduced. In the same manner, the distance 9 between the weapon support 2 and the lock 7 has increased. The concretely present barrel return travel is measured by the sensor 8.

Figure 3:
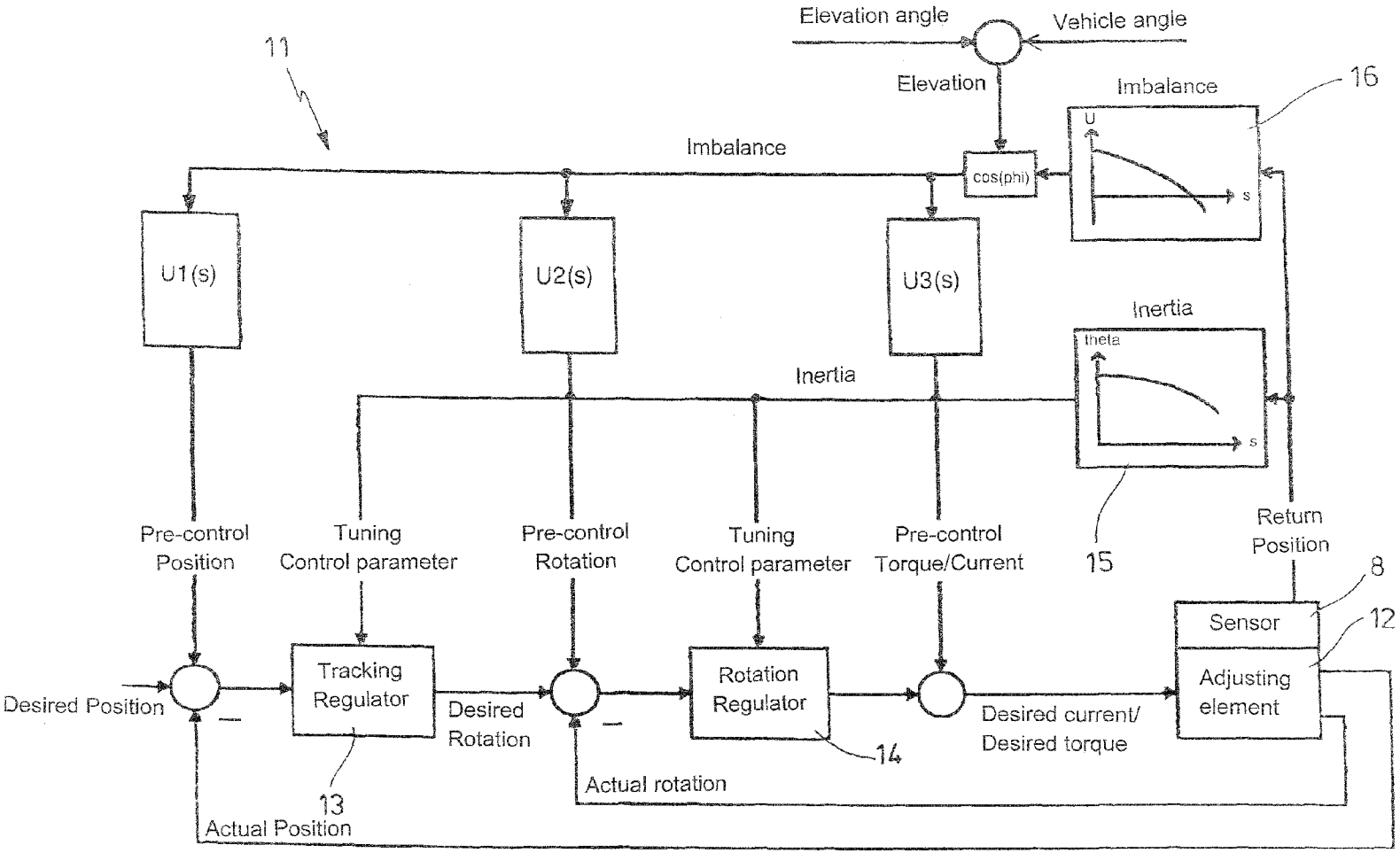
FIG. 3 is a schematic block diagram of a forward control with superimposed cascade-type regulation.

FIG. 3 shows a schematic block diagram of a control device 11 which acts on an adjusting element 12 which is used for positioning the weapon barrel 1. According to an embodiment, it is particularly intended that the adjusting element 12 is constructed as an electric motor which has as an input value a desired current or a desired torque. In this connection, output values of the adjusting element 12 are an actual rate of rotation value and a position actual value which can be measured through sensors, not illustrated.

In the illustrated cascade-type regulation, a desired value is given for the position and is compared to an actual value. The corresponding regulation deviation is supplied to a tracking regulator 13. The output value of the tracking regulator is a desired value for the rate of rotation. A regulating difference between the desired value of the rate of rotation and the actual value of the rate of rotation is supplied to the input of a rate of rotation regulator 14 whose output value is the desired current or the desired torque for the adjusting member 12. The return travel positioning measured by the sensor 8 is used for carrying out a preliminary control. In the illustrated embodiment, a pre-control takes place with respect to the imbalance and the inertia. For this purpose, the characteristic line 15 for the imbalance and a characteristic line 16 for the inertia are implemented.

The characteristic lines 15, 16 can be stored, for example, as tables; however, it is also possible to carry out a functional computation with the use of suitable processors. An output value made available by the characteristic line 16 for the inertia serves for changing the regulator parameters of the tracking regulator 13 and/or the rate of rotation regulator 14. This makes it possible to maintain unchanged the dynamics of the regulation circuit in spite of changing system parameters. In the case of large changes, instabilities of the system can be avoided.

The output value made available by the characteristic line 15 for the imbalance is supplied with the use of transmitter functions U1, U2 and U3 to the respective difference formations for the regulation deviations and, thus, causes a pre-control. In the illustrated embodiment, the transmission function U1 of the pre-control is for the position, the transmission function U2 of the pre-control is for the rate of rotation and the transmission function U3 of the pre-control is for the torque or the current of the drive motor.

In particular in a moving vehicle, it is found to be advantageous to take into consideration the elevation angle of the longitudinal axis 3 relative to the vehicle and the vehicle angle of the vehicle relative to the horizontal direction. The corresponding combination of the respective values results in the weapon elevation Φ (phi) from which the co-sine (Φ) is computed taking into consideration the initial value of the characteristic line 15 for the imbalance. This value is then the input value for the transmission functions U1, U2 and U3.

Generally, it is also conceivable to utilize the inertia and the imbalance determined with the use of the sensor 8 in a regulating structure which does not have tracking. Moreover, in accordance with a variation of the regulation concept, it is possible to develop a condition regulator which takes into consideration the inertia and the imbalance as input values.

Finally, it is also conceivable to implement the pre-control illustrated in FIG. 3 without adaptation to the dynamics of the regulator. In the same manner, it is conceivable to carry out only one adaptation of the dynamics of the regulators without also implementing the pre-control. However, the illustrated combination of both measures leads to significant advantages.

The invention claimed is:

1. A method for adjusting a positioning of a longitudinal axis of a weapon barrel, the method comprising the steps of: providing a weapon barrel and a weapon support, the weapon barrel having a longitudinal axis; measuring a positioning of the weapon barrel relative to the weapon support to produce determined measurement values; supplying the determined measurement values to a control device to produce an input value, the control device acting on an adjusting device in accordance with a predetermined functional relationship between the determined measurement values and the input value, the adjusting element being configured for positioning the weapon barrel relative to the horizontal direction by an adjusting angle and for displacing the barrel from the weapon support in a direction of the longitudinal axis.

2. The method according to claim 1, including using the measurement values exclusively for controlling the adjusting element.

3. The method according to claim 1, including using the measurement values for a pre-control as a portion of a regulation.

4. The method according to claim 1, wherein the adjusting element is an electric motor.

5. The method according to claim 1, including using the adjusting element as part of a cascade-type regulation.

6. The method according to claim 1, including using the adjusting element with a value for motor current as a desired value.

7. The method according to claim 1, including carrying out a pre-control with respect to two parameters.

8. The method according to claim 7, including carrying out the pre-control with respect to motor current as well as with respect to a rate of rotation and a position.

9. A device for firing projectiles, comprising; a weapon support; a weapon barrel guided by the weapon support; an adjusting element for positioning the barrel with a longitudinal axis relative to the horizontal direction by an adjusting angle, and for displacing the weapon barrel from the weapon support in the direction of the longitudinal axis; a control device; and at least one sensor connected to the control device for determining a positioning of the weapon barrel relative to the weapon support and for producing determined measurement data, wherein the control device acts on the adjusting element with an input value which is determinable by a functional relationship from the determined measurement data.

10. The device according to claim 9, wherein the sensor is connected exclusively to a control for the adjusting element.

11. The device according to claim 9, wherein the sensor is connected to a pre-control as well as to a superimposed regulation.

12. The device according to claim 9, wherein the adjusting element is an electric motor.

13. The device according to claim 9, wherein the control device comprises a cascade-type regulation.

14. The device according to claim 9, wherein the adjusting element has a momentary desired value as the input value.

15. The device according to claim 11, wherein the pre-control is constructed for generating pre-control values for at least two different parameters.

16. The device according to claim 15, wherein the pre-control for generating pre-control values is constructed for torque as well as for rate of rotation and position.

* * * * *